United States Patent [19]

Beck

[11] Patent Number: 4,984,716

[45] Date of Patent: Jan. 15, 1991

[54] TWO PIECE TAMPER EVIDENT HINGED CLOSURE CAP

[75] Inventor: James M. Beck, Carol Stream, Ill.

[73] Assignee: Creative Packaging Corporation, Wheeling, Ill.

[21] Appl. No.: 317,542

[22] Filed: Mar. 1, 1989

[51] Int. Cl.[5] ..... B67B 5/00

[52] U.S. Cl. ..... 222/153; 222/541; 215/255; 215/256

[58] Field of Search ..... 222/541, 153, 23; 215/250, 253, 254, 255, 256, 235; 220/270, 276, 266, 269

[56] References Cited

U.S. PATENT DOCUMENTS

| | | | |
|---|---|---|---|
| 3,272,368 | 9/1966 | Van Baarn | 215/235 |
| 3,459,315 | 8/1969 | Labarre | 222/541 X |
| 3,651,992 | 3/1972 | Hazard | 222/153 |
| 4,022,357 | 5/1977 | Dwinell | 222/541 X |
| 4,076,151 | 2/1978 | Littlefield | 222/541 X |
| 4,487,324 | 12/1984 | Ostrowsky | 215/253 |
| 4,534,481 | 8/1985 | Summers et al. | 215/255 X |
| 4,682,702 | 7/1987 | Gach | 222/541 X |
| 4,784,279 | 11/1988 | Osting et al. | 215/254 X |
| 4,941,592 | 7/1990 | Kitterman | 222/541 |

FOREIGN PATENT DOCUMENTS

| | | | |
|---|---|---|---|
| 2127387 | 4/1984 | United Kingdom | 215/256 |
| 2151216 | 7/1985 | United Kingdom | 215/256 |

*Primary Examiner*—H. Grant Skaggs
*Assistant Examiner*—Boris Milef
*Attorney, Agent, or Firm*—Hill, Van Santen, Steadman & Simpson

[57] ABSTRACT

A tamper evidencing or evident closure for a container having a dispensing orifice includes separately formed cap and base sections, the base section engaging an opening of the container and including an orifice member through which contents of the container are dispensed, the cap section including a skirt to which a cap is hingedly attached and a pair of tear strips formed around a lower edge of the cap member that are frangibly connected between the cap and the skirt portion so as to prevent opening of the cap without breaking of connections between the tear strip and the cap. A pull ring concentrically formed about the cap member and attached to ends of the tear strips, but not attached to the cap member, is included so that the tear strips can be torn away from the cap and skirt by simply pulling up on the pull ring.

4 Claims, 1 Drawing Sheet

TWO PIECE TAMPER EVIDENT HINGED CLOSURE CAP

BACKGROUND OF THE INVENTION

1. Field of the Invention

The present invention generally relates to container closures. More specifically, the invention relates to a tamper evident or evidencing container closure of the type having a dispensing orifice and a closure cap.

2. Discussion of the Relevant Art

In recent years, a heightened emphasis has been placed upon utilization or tamper proof of tamper evidencing or evident closures for containers. This is particularly true for containers utilized for storage of human ingestible materials.

A known class of such containers employs caps or closures having dispensing orifices therethrough. Such orifices may be used in connection with, for example, squeeze bottles or the like. A typical such cap includes a base section which closes the container except for a dispensing opening and a movable stopper section providing a plug or stopper for the opening. In such caps the stopper carrying section is movable from an orifice closing position to an orifice opening position. The stopper carrying section may be in integral part of the closure, as shown, for example, in U.S. Pat. No. 4,124,151, or may be formed as a separate but attached piece as shown, for example, in U.S. Pat. Nos. 4,595,123 and 4,441,637.

Such stopper carrying section must, of necessity, be relatively easy to open to allow the container to be used for its intended purpose. However, ease of opening of the stopper carrying section allows for possible tampering with the contents of the container to occur. While it is known to utilize foil or paper seal overlays covering the openings of the containers beneath the base top surface section, which overlays must be broken or removed prior to dispensing of the contents of the containers, such overlays are not a sufficient detriment to tampering. For example, stick-on overlays can be surreptitiously opened by steaming or the like. Additionally, the overlays can be an undesired added expense.

It has also been known to make the stopper carrying section physically a part of the base top surface section and to provide a tear strip portion in the connection between the two sections (see U.S. Pat. Nos. 3,255,928; 3,651,992; and 4,081,108). While such tear strip portions provide an indication of tampering, they are often difficult or inconvenient to remove or require very difficult molding or assembly.

It would therefore be an advance in the art to provide a dispensing orifice type closure having means preventing opening of the stopper carrying member which means are easily removable but which, when removed, provided indication of tampering, and which means further are both inexpensive and difficult to circumvent.

It would be a further advance in the art if such a tamper evidencing or evident closure could be provided in connection with an easily attached but substantially nonremovable closure cap to container interface.

SUMMARY OF THE INVENTION

The present invention provides a tamper evident or evidencing container closure of the dispensing orifice type, wherein the closure includes separate orifice and stopper sections, the stopper section including at least one tear strip connected about a stopper closure cap between the stopper and a skirt to indicate tampering. A pull ring positioned concentrically about the closure portion of the cap is also attached to the tear strip so that removal of the ring enables removal of the tear strip simply by pulling on the ring.

In a preferred format, the closure consists of a separately molded closure disc having a dispensing orifice therethrough, and a substantially cup-shaped cap member having a peripheral skirt for a fixture to the throat opening of a container. The cup-shaped cap member has means for retaining interiorly thereof a disc, and is provided with a hinged top portion having a stopper formed on an undersurface thereof, the stopper adapted to close the orifice of the disc. Intermediate the skirt and portions of the hinged portion are interconnected tear strips integrally molded as a part of the cup-shaped cap. The tear strips are also integrally molded with a ring member that surrounds the pivotal portion and is spaced therefrom and from the skirt to be easily graspable. The tear strips prevent pivoting of the stopper carrying portion until removed. The pull ring allows for expeditious and easy removal of the tear strips. Living hinge connection may be provided between the pivotal portion and the remaining portions of the cap.

Accordingly, it is a principle object of the invention to provide an improved tamper indicating container closure.

It is another object of the invention to provide a tamper evident closure for a container with a dispensing orifice therethrough, wherein removal or attempted removal of the closure cap is evidenced by means of a tear strip frangibly connected to the closure cap.

It is yet another object of the invention to provide a tamper resistent container closure including a cap adapted to be received on the neck of a container with cap removal resisting means on the inner diameter of a cap skirt and on the outer diameter of the cap, which means resists removal of the cap.

Further objects, features, and advantages of the invention will be readily apparent from the following description of the preferred embodiments thereof, taken in conjunction with the accompanying drawings.

DETAILED DESCRIPTION OF THE PREFERRED EMBODIMENT

Figure 1:
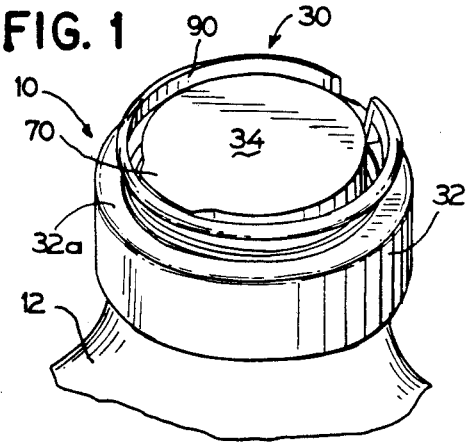
FIG. 1 is a perspective view of a closure cap embodying principles of the invention positioned on a container.
Figure 2:
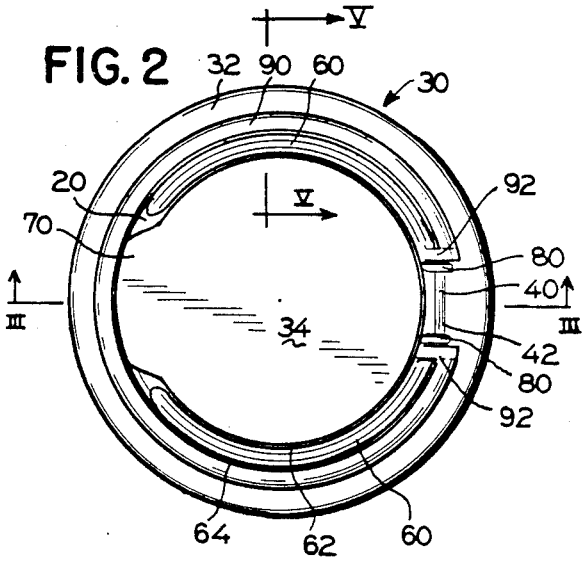
FIG. 2 is a top view of the closure cap of FIG. 1.

In FIG. 1 there is illustrated a closure 10 positioned on a container 12. The closure 10 includes means for evidencing tampering or attempted tampering with contents of a container 12 having a top flange 14 and neck 15 with a top edge 16 surrounded by a peripheral projection or bend 17 in accordance with principles of the invention.

With reference to FIGS. 1–4, it can be seen that the closure cap 10 includes separate base and cap sections 20 and 30, respectively. The base section 20 is located at and engages the opening 14 of the container 12. The cap section 30 is positioned on and about the base section 20 and the opening 14.

Figure 3:
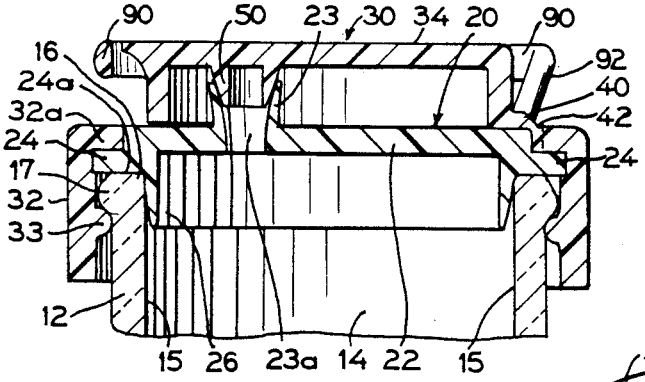
FIG. 3 is a cross-sectional view of the closure cap of FIG. 1 generally taken along the line III—III in FIG. 2.
Figure 4:
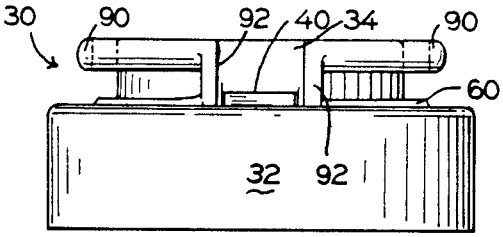
FIG. 4 is an elevational view of the closure cap of FIG. 1 when viewed from its hinged side.
Figure 7:
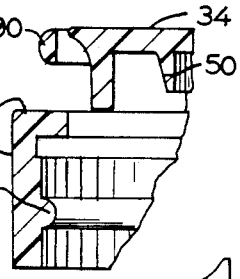
FIG. 7 is a partial cross-sectional view of the cap section of the closure cap of FIG. 1 generally taken along the line III—III of FIG. 2.

As is most clearly illustrated in FIG. 3, the base section 20 includes a top plate member or portion 22 having an orifice member 23 projecting upwardly therefrom, which orifice member includes an opening 23*a* therethrough for dispensing of the contents of the container 12. A flange 24 is integrally formed with the plate member 22 and projects radially from an underside of the plate member 22, such that the flange 24 defines an axial step around the periphery of the plate member. An annular resilient portion 26, also integrally formed with the plate member 22, extends vertically downward from the underside of the plate member 22 and fits within the opening 14 of the container 12, so as to snuggly abut against interiors of a wall or neck portion 15 defining the opening 14.

As illustrated, an underside 24*a* of the flange 24 lays on top of the top edge 16 of neck 15 and acts as a seal. The flange 24 extends out to the adjacent outside diameter of the neck 15. The plate member 22 does not extend to that diameter and as such, the plate member 22 and the flange 24 form a stepped arrangement at the top sides thereof.

The cap section 30, as illustrated in FIGS. 1–4, includes a lower skirt portion 32 and a hinged cap 34. The lower skirt portion 32 is annular in shape and fits about the neck 15 of the container 12. The skirt portion 32 includes a circular rib or bead portion 33 that runs along the interior of the skirt 32. The rib or bead 33 engages an underside of the rib, rim, or projection portion 17 of the neck 15 so as to retain the cap section 30 on the neck 15 of the container 12. As such, the cap section 30 is not screwed onto the neck 15, but instead is press fit thereon so that it cannot be removed.

Figure 8:
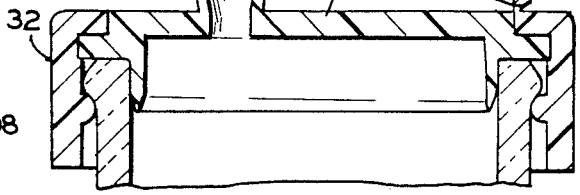
FIG. 8 is a cross-sectional view of the closure cap of FIG. 1 generally taken along the line III-III in FIG. 2, but illustrating the cap section in its open position.

The cap section 30 also includes an inwardly extending annular wall 32*a* at a top edge of the skirt 32 in the shape of a flattened ring. It can be appreciated from the cross-sectional view of FIG. 3, that the wall 32*a* of cap section 30 also serves to retain the base section 20 and cap section 30 on the neck 15 by overlying the flange 24. The flange periphery may seat in a groove 200 formed in the I.D. of the skirt below the wall 32*a*. It can be seen that the cap 34 is hingedly attached to the skirt portion 32 by means of a bridging hinge 40 formed of material that extends between the skirt 32 and the cap 34 and that has appropriately formed crease 42 therealong. The crease 42 permits the cap 34 to be moved between a closed position as illustrated in FIG. 3, to an open position as illustrated in FIG. 8.

The cap 34 further includes a stop member 50 formed on an underside thereof that engages the opening 23*a* of the orifice member 23 when the cap 34 is in its closed position. In a preferred embodiment, the stop member and orifice member 23 are designed for frictional engagement therebetween to secure the cap 34 in its closed position. However, other means are available for securing the cap 34 in its closed position, as will become apparent below.

At the same time that the cap 34 and skirt 32 are formed, a pair of tear strips 60 are formed such that they connect between a lower edge 62 of the cap 34 and an inside edge 64 of the wall 32*a* of the skirt 32, on opposite sides of the cap 34. The tear strips 60 do not encircle the entire cap 34. Instead, the tear strips 60 on a front side of the cap 34 are separated by a distance sufficient to permit formation or molding of a lift tab 70 for moving the cap 34 between its open and closed positions, preferably a distance of above 20% of the circumference of the cap 34. On a back side of the cap 34, the tear strips 60 are separated by a distance sufficient to permit formation of the hinged bridge 40. Additionally, on opposite sides of the hinged bridge 40, there are formed slots 80 that isolate the hinge 40 from the tearing action of the tear strips 60 so that the integrity of the hinge 40 is not destroyed when the tear strips 60 are removed.

Figure 5:
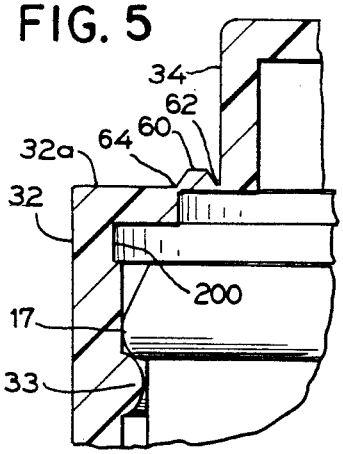
FIG. 5 is a partial cross-sectional view of the closure cap of FIG. 1 generally taken along the line V—V in FIG. 2.
Figure 5:
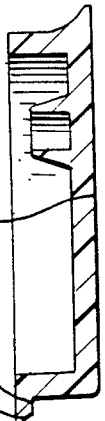

As is most clearly illustrated in FIG. 5, each of the tear strips 60 includes one edge connected to the lower edge 62 of the cap 34 and another edge connected to an inside edge 64 of the inwardly extending ring 32*a* of the skirt 32. The edges are frangible so that the tear strip 60 can be easily removed, but so that they cannot again be replaced. These frangible edges can be created by perforations or sufficient thinning of the material forming the connecting edges.

Also included in the cap section 30 is a pull ring 90 utilized to pull at the tear strips 60 so that the tear strips 60 can be removed. This ring 90 is concentrically positioned about the cap 34 but is not connected thereto, except for a connection to the tear strip adjacent the living hinge 40. This is clearly illustrated in FIG. 3.

The pull ring 90 is formed so as to be positioned at the height of the top of the cap 34 and includes two downwardly angled bridge members 92 that connect between the pull ring 90 and the tear strips 60. It can be appreciated, that when the tear strips 60 are to be removed, one simply grasps the pull ring 90 and pulls upwardly relative to the cap 34 until the tear strips 60 are removed or otherwise torn away. The pull ring 90 will cause the tear strips 60 to commence tearing at the hinged side of the cap 34 and then to proceed tearing toward the lift tab 70 side of the cap 34.

Figure 6:
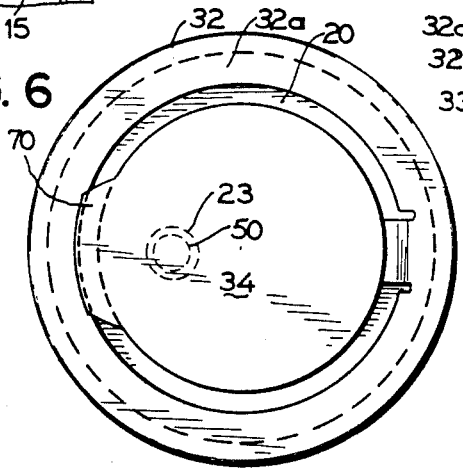
FIG. 6 is a top view of the closure cap of FIG. 1 after removal of the tear strip.

Once the tear strips 60 have been removed, the cap section 30 will appear from a top view as is illustrated in FIG. 6. In the top side of the wall 32*a* of the skirt 32 is fully visible. Moreover, the portions of the top side of the base section 20 previously covered by the tear strips are now visible. At this point, the cap 34 can be freely moved between opened and closed positions. It can be appreciated, however, that without removal of the tear strips 60, the closure cap 34 is precluded from being moved to its open position because it would be secured to the skirt 32.

Figure 9:
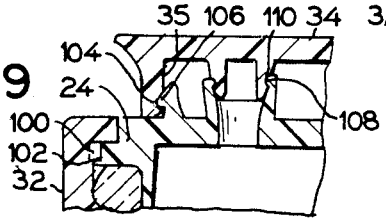
FIG. 9 is a partial cross-sectional view of a closure cap embodying a combination of further principles of the invention.

In FIG. 9, there are illustrated additional features of the invention.

It can be appreciated that because the cap and base sections 30 and 20, respectively, are separately formed, it is possible that the cap section 30 can become rotationally misaligned relative to the base section 20. This would not be a problem if the orifice member 23 were centrally located on the base section 20. However, if the orifice member 23 is not centrally located on the base section 20, then the stopper member 50 and the orifice member 23 can become so misaligned that they no longer engage one another.

To maintain the cap and base sections 30 and 20, respectively, in rotational alignment, there can be provided a detent member 100, projecting from the grove 200, in the skirt 32 that projects into an appropriately formed indentation or opening 102 in the flange 24 of the base section 20, as illustrated in FIG. 9. Of course, other systems can be employed to accomplish alignment between the cap and base sections 30 and 20, respectively.

Additionally, other means for securing the cap 34 in its closed position are contemplated. For example, the interior of the annular wall 35 of the cap can contain a notch 104 that is engaged by a projection 106 that extends from the base section 20. Similarly, the orifice member 23 can contain a rib 108 or other detents that extend inwardly and engage mating notches 110 in the stopper. Many other schemes are also possible.

With respect to the materials of which the closure 10 is made, in the preferred embodiment, the cap and base sections are formed of a thermo-plastic material that is easily molded. However, thermoset plastics and other materials are also contemplated.

While a preferred embodiment has been shown, modifications and changes may become apparent to those skilled in the art which shall fall within the spirit and scope of the invention. It is intended that such modifications and changes be covered by the attached claims.

I claim:

1. A tamper evident closure for a container having an opening for dispensing contents therein, comprising:

(a) a base section engaged within said opening, said base section including a central plate section that covers said opening, an orifice in said central plate section, an annular wall that depends downwardly from said central plate section such that an outside diameter of said annular wall engages an inside diameter of said opening, and a flange that extends radially outward from said annular wall and over a top edge of said opening, said flange forming a horizontal surface at a level below that of an upper surface of said plate section;

(b) a skirt member adapted to engage about said opening in non-removable fashion and to retain said base section in engagement with said opening, skirt member including an inwardly extending flange that overlays said outwardly extending flange of said base section, a circumferential groove that rings an inside diameter of said skirt member so as to capture said radially outwardly extending flange of said base section, and a circumferential bead that also rings the inside diameter of said skirt member so as to engage beneath an outwardly directed bead on an outside diameter of the top edge of said opening;

(c) a cap member hinged attached to said skirt member by means of a living hinge member, said cap member adapted to move between opened and closed positions and including a stopper member on said cap member adapted to engage said orifice in said central plate section when said cap member is in its closed position, said cap member being positioned on said central plate section in its closed position;

(d) a pair of tear strips connecting said cap member and said skirt member by means of integrally molded frangible connections to both said skirt member and said cap member, said tear strips being shaped so as to follow a contour of a lower edge of said cap member and connecting between said inwardly extending flange of said skirt member and said lower edge of said cap member, said tear strips precluding movement of said cap member to its open position without breaking of said frangible connections; and (e) a grasping member attached to said tear strips and elevated above said skirt member, said grasping member substantially comprising a ring concentrically positioned about a top edge of said cap member and including two downwardly depending legs that extend down to and attach to terminal ends of said tear strips positioned adjacent opposite sides adjacent said living hinge member so that said frangible connections can be broken by grasping and upward pulling of said ring member.

2. A tamper evident closure as set forth in claim 1, wherein said two tear strip members that form about a lower edge of said cap member have two back ends positioned on opposite sides of said hinge, and said tear strip members have opposite front ends separated from each other and positioned on a side of said cap member opposite of said hinge.

3. A tamper evident closure as set forth in claim 2, wherein said front ends of said tear strip members are separated by a distance of about 20% of a circumference of said cap member.

4. A tamper evident closure as set forth in claim 2, wherein each of said back ends of said tear strips separated from said hinge by a slot that serves to isolate said hinge from said tearing action of said strips.

* * * * *